United States Patent [19]

Pomonik

[11] 4,295,237

[45] Oct. 20, 1981

[54] HOSE ARM COUPLING FOR UNDERWATER FLUID SWIVEL

[75] Inventor: George M. Pomonik, Van Nuys, Calif.

[73] Assignee: Amtel, Inc., Providence, R.I.

[21] Appl. No.: 961,991

[22] Filed: Nov. 20, 1978

[51] Int. Cl.[3] ..... B65B 3/04

[52] U.S. Cl. ..... 9/8 P; 137/236 S

[58] Field of Search ..... 9/8 P; 137/236, 580, 137/615; 285/45, 134, 136, 137, 272, 331; 141/44, 387, 388

[56] References Cited

U.S. PATENT DOCUMENTS

| | | | |
|---|---|---|---|
| 2,586,991 | 2/1952 | Postel | 285/272 |
| 3,409,055 | 11/1968 | Bily | 9/8 P |
| 3,838,718 | 10/1974 | Flory et al. | 9/8 P |
| 4,026,119 | 5/1977 | Dotti | 9/8 P |

*Primary Examiner*—Trygve M. Blix
*Assistant Examiner*—Jesus D. Sotelo
*Attorney, Agent, or Firm*—Freilich, Hornbaker, Wasserman, Rosen & Fernandez

[57] ABSTRACT

An arrangement for connecting an underwater product distribution unit (PDU) to a hose that extends up to a ship, which is simple in construction and yet which enables the hose structure to apply considerable torque to rotate the outer portion of the PDU to follow the ship as it drifts about the PDU. The coupling includes a rigid pipe extending largely perpendicular to the vertical axis of the PDU, with an outer end of the pipe connected to a hose leading to the ship and an inner end of the pipe pivotally connected to the rotatable portion of the PDU in a joint that permits the pipe to pivot up and down.

4 Claims, 4 Drawing Figures

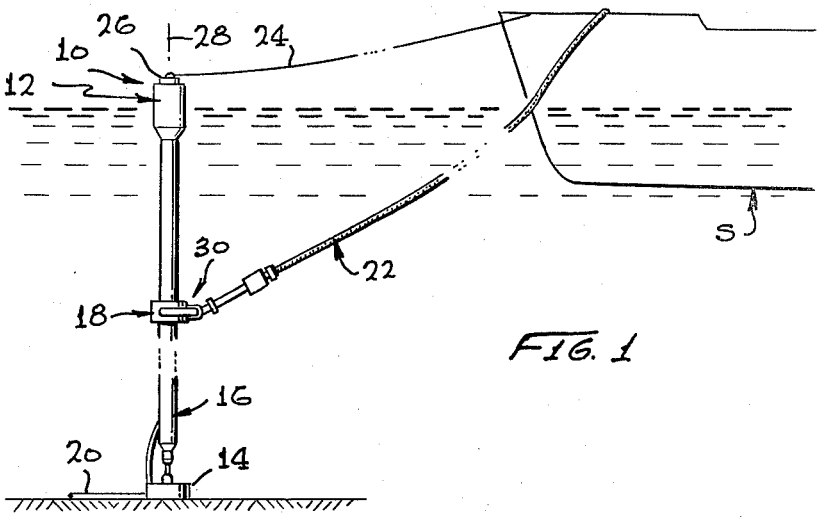
FIG. 1
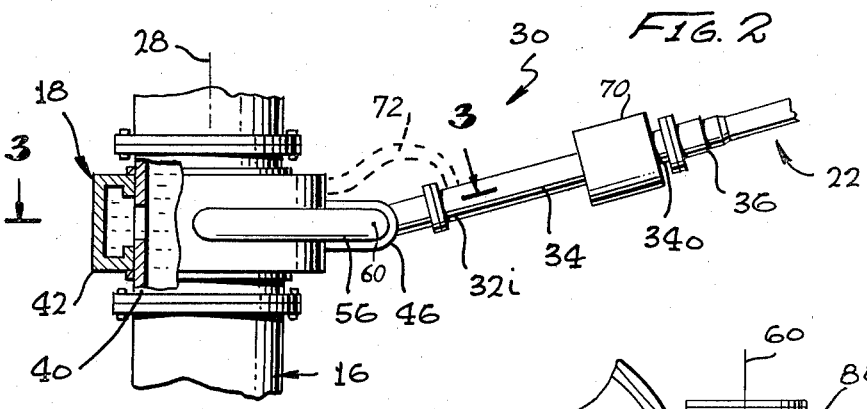
FIG. 2
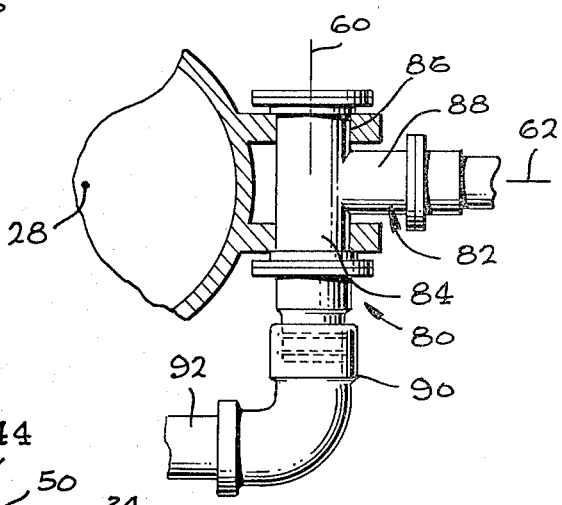
FIG. 4
FIG. 3
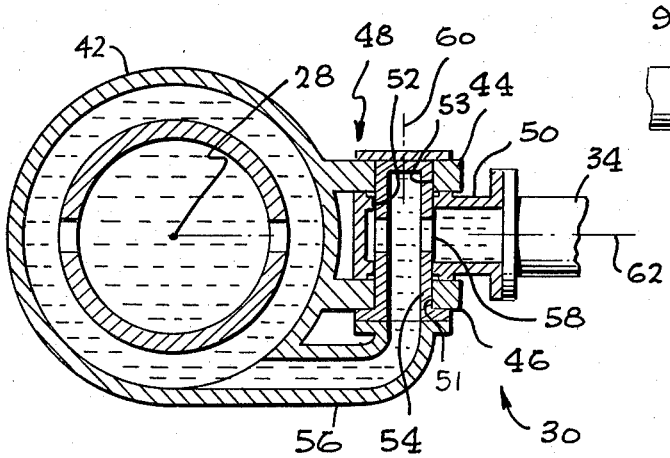

HOSE ARM COUPLING FOR UNDERWATER FLUID SWIVEL

BACKGROUND OF THE INVENTION

Petroleum or other cargo is often transferred to or from tankers by mooring and cargo handling systems that lie in the sea and which are connected by pipelines that run along the sea bottom to the shore or a nearby installation. The system includes an anchored buoy to which a ship can be moored and one or more hoses that can extend to the ship. The system is normally constructed so that a ship that is moored to the buoy and connected to the cargo transfer hoses, can drift freely about the buoy under the influence of wind, waves, and current. The cargo-carrying hose or hoses can be connected between the ship and mooring foundation by way of a rotary fluid coupling or product distribution unit (PDU) which may be located underwater to isolate it from wave action. It is important that the rotatable portion of the PDU easily turn as the ship drifts about the buoy, to avoid wrapping the hose about the buoy, and yet this should be accomplished with minimal stress on the hose leading to the ship. U.S. Pat. No. 3,840,927 by Reid shows various underwater PDUs. U.S. Pat. No. 3,883,912 shows an underwater PDU with a hose arm coupling designed to maximize rotating torque with minimal stress on the hose, but it requires a pair of connections to the PDU which must be merged. A coupling of simple and light weight construction which aided in turning the rotatable portion of a PDU with minimal hose stresses, would facilitate the construction of reliable and low cost cargo transfer installations.

SUMMARY OF THE INVENTION

In accordance with one embodiment of the present invention, a mooring and cargo transfer installation is provided wherein a hose structure is coupled to a product distribution unit (PDU) in a manner that facilitates rotation of the PDU with minimal hose stresses, utilizing a coupling of relatively simple design. The coupling includes a rigid pipe having an outer end connected to a hose that leads to the ship, and having an inner end connected to the rotatable portion of the PDU. The pipe extends substantially along a line intersecting the vertical axis of rotation of the PDU, as seen in a plan view. The inner end of the pipe is connected to the PDU in a joint that permits the pipe to pivot about a horizontal axis to let the hose move up and down, but which substantially fixes the pipe with respect to the PDU in rotation about a vertical axis so that forces on the pipe tending to turn it about the buoy installation cause rotation of the PDU.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of a buoy installation constructed in accordance with one embodiment of the present invention.

FIG. 2 is a partially sectional view of a portion of the installation of FIG. 1.

FIG. 3 is a view taken on the line 3—3 of FIG. 2.

FIG. 4 is a partially section plan view of a buoy installation constructed in accordance with another embodiment of the invention.

DESCRIPTION OF THE PREFERRED EMBODIMENTS

FIG. 1 illustrates a mooring and cargo transfer system 10 which includes a mooring buoy 12 that floats at the surface of a sea, a mooring foundation or base 14 at the bottom of the sea, and a tension apparatus 16 that connects the base to the buoy. The tension apparatus 16 can be formed in part or whole as a column or chain. A swivel unit or product distribution unit (PDU) 18 lies along the tension apparatus and is coupled through a conduit in the lower portion of the tension apparatus to a pipe line 20 lying at the sea bottom. The PDU 18 is also coupled through a hose structure 22 to a ship S. The ship is moored through a hawser line 24 to a rotatable connector 26 at the top of the buoy. The ship S may move about the buoy installation, and a rotatable portion of the PDU rotates with the hose 22 to follow the ship.

The PDU is located a distance below the surface of the water to isolate it and the hose from waves and other surface disturbances. It is important that the PDU rotate easily about the vertical axis 28 of the buoy installation to avoid wrapping of the hose about the tension apparatus. It is also necessary that the hose structure 22 be permitted to move up and down somewhat under the influence of waves without transmitting such forces to the PDU 18. It is also advantageous that a coupling 30 which couples the end of the hose structure 22 to the PDU, accomplish the foregoing in a structure that is as simple in construction as possible, to miminize the weight and expense of the coupling as well as to maximize reliability and minimize the cost of repairs.

As also shown in FIGS. 2 and 3, the coupling 30 which connects an end of the hose structure 22 to the PDU 18, includes an elongated rigid structure comprising a rigid pipe 34 having an outer end 34*o* connected, through a flexible joint 36, to the hose structure 22, and having an inner end 32*i* connected to the PDU 18. The center of the rigid pipe serves as a conduit to carry a cargo between the PDU and the hose structure 22.

The PDU includes a stationary portion 40 which is fixed to the rest of the tension apparatus 16, and a rotatable portion 42 which rotates on the fixed portion about the vertical axis 28. In order to connect the rotatable portion 42 of the PDU to the rigid pipe 34, the rotatable portion is provided with a pair of flanges 44, 46 (FIG. 3). The rigid pipe 34 is connected through a joint 48 lying between the flanges 44, 46. The joint includes an outer part formed by a pipe portion 50 with a hole 52, and an inner part formed by a perpendicular pipe 54 extending through the hole 52 and mounted on the two flanges 44, 46 in holes 51, 53 thereof. The pipe 54 is connected by a conduit 56 to the inside of the rotatable portion 42 of the PDU, and the pipe 54 has holes 58 communicating with the transverse pipe 50 that connects to the rigid pipe 34. Thus, the rigid pipe 34 is able to pivot about a substantially horizontal axis 60 that is spaced from the vertical axis 28 by slightly more than the radius of the PDU, to permit the rigid pipe 34 to move up and down together with the hose structure 22. However, when the hose structure 22 begins to turn about the vertical axis 28 of the mooring installation, such forces are transmitted through the pipe 50 to the flanges 44, 46 of the PDU, to turn the PDU about the vertical axis 28. The rigid pipe 34 extends along a line 62 which is substantially perpendicular to the vertical axis of rotation 28 of the PDU, as seen in a top or plan view, as in FIG. 3.

It is useful to maintain the rigid pipe 34 so it normally extends in a largely horizontal direction away from the PDU, as shown in FIG. 2. The pipe 34 is negatively buoyant, and the hose structure 22 is positively buoyant when unfilled with oil or other liquid cargo. A buoyant or ballast compensating device 70 makes the overall rigid pipe and hose structure slightly positively buoyant. It is desirable that the pipe 34 normally extend in a largely horizontal direction, so that it can pivot by almost 90° up and down under the influence of waves. The actual orientation of the pipe 34 depends upon how far the ship S is spaced from the buoy installation, or whether or not the hose is connected to a ship or is free floating, whether or not the hose is filled with a cargo and the density thereof, and other factors.

When the ship drifts about the buoy installation, sideward forces on the hose structure 22 are transferred through the coupling 30 to the rotatable portion 42 of the PDU to rotate it. The rigid pipe 34 provides a long moment arm, that converts moderate sideward forces on the hose structure 22 into a considerable torque tending to rotate the PDU. This is accomplished using a single pipe 34 and a single fluid coupling connecting the pipe to the rotatable portion of the PDU. The single rotatable joint 48 minimizes the number of parts in the coupling, as compared to a system wherein two rigid pipes are utilized which must each be pivotally connected to opposite sides of the PDU.

Although a fluid joint 48 can be utilized to connect the rigid pipe to the PDU, it is also possible to utilize a separate flexible hose connection as indicated at 72 in FIG. 2, and to utilize a simple non-fluid-carrying joint to connect the inner end of the rigid pipe 34 to the rotatable portion of the PDU. In that case, the fluid connection by way of the hose 72, can carry fluid through the rigid pipe 34, or can extend along the rigid pipe and connect to the hose structure 22. In any case, the rigid pipe structure formed by the rigid pipe 34 itself or with a hose fixed to it, is utilized to transmit torque and carry fluid.

FIG. 4 illustrates a buoy installation constructed in accordance with another embodiment of the invention, with a joint 80 which can he constructed primarily out of off-the-shelf components. The joint includes a T pipe coupling 82 with the opposite ends 84, 86 of the cross portion of the T rotatably mounted on the flanges 44, 46 of the PDU, and with the stem 88 of the T connected to the rigid pipe 34. A separate swivel joint 90 is provided to enable rotation about the horizontal axis 60, and is connected by a PDU-connected pipe 92 to the rotatable portion of the PDU.

Thus, the invention provides a coupling for connecting a hose structure to the rotatable portion of a PDU, which transmits torque tending to rotate the PDU about a vertical axis while isolating it from up and down oscillation of the hose structure, all with a relatively simple single arm rigid pipe structure. The rigid pipe structure includes a rigid pipe extending substantially along a line that intersects the vertical axis of rotation of the PDU, as seen in a plan view. The inner end of the rigid pipe is connected to the PDU in a joint that prevents relatively rotation about a vertical axis, but which does permit the pipe to oscillate up and down about a horizontal axis. The PDU can be provided with a pair of flanges on its rotatable portion, and the rigid pipe can include a portion rotatably mounted about a horizontal axis between the flanges. The rotatable joint can include a fluid joint that carries fluid from the rotatable portion of the PDU through the rigid pipe to the hose structure that extends to a ship.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In a mooring and cargo transfer installation which includes a product distribution unit having a stationary portion coupled to the sea floor and a rotatable portion rotatable without limit about a vertical axis for coupling through a hose to a vessel that may drift thereabout, the improvement comprising:

a pair of horizontally-spaced flanges fixed to the outside of said rotatable portion of the product distribution unit;

a fluid joint having a member pivotally coupled to said flanges to pivot about a substantially horizontal axis extending through said flanges and lying outside said rotatable portion of said product distribution unit; and an elongated rigid structure which includes a fluid conduit extending along its length, said structure having an inner end connected to said fluid joint member and an outer end coupled to said hose.

2. The improvement described in claim 1 wherein:

said elongated structure includes a rigid pipe with inner and outer ends; and said fluid joint includes an inner part (54) fixed to said flanges and an outer part (50) rotatable about said horizontal axis on the inner part and connected to the rigid pipe inner end, one of said flanges (46) having an opening (51) at least adjacent to said horizontal axis, and said fluid joint also includes a PDU-connected pipe (56) having one end in fluid communication with said joint inner part (54) and having another end communicating with said rotatable portion of said product distribution unit.

3. The improvement described in claim 1 wherein:

said elongated structure includes a rigid pipe with inner and outer ends; and said fluid joint includes a T-shaped coupling having a stem portion connected to said rigid pipe and a pair of cross portions ends rotatably mounted on said flanges, a PDU-connected pipe connected to said rotatable portion of said product distribution unit, and a swivel joint positioned with its axis of rotation in line with the cross portion of said T coupling and having opposite ends respectively coupled to one of said cross portion ends and to said PDU-connected pipe.

4. In a mooring and cargo transfer installation which includes a product distribution unit having a stationary portion coupled to the sea floor and a rotatable portion rotatable without limit about a vertical axis for coupling through a hose to a vessel that may drift thereabout, the improvement comprising:

a pair of horizontally-spaced flanges extending from one side of the rotatable portion of said product distribution unit, one of said flanges having a hole in it;

a fluid conduit extending from the rotatable portion of the product distribution unit and communicating with said hole in said flange;

a rigid pipe extending substantially along a line intersecting the vertical axis of said product distribution unit, said rigid pipe having an outer end coupled to said hose and an inner end; and a pipe joint member connected to the inner end of said rigid pipe and pivotally mounted about a horizontal axis between said flanges and in fluid communication with said fluid conduit in a fluid path extending through said hole in said flange.

* * * * *